US007273957B2

(12) United States Patent
Bakshi et al.

(10) Patent No.: US 7,273,957 B2
(45) Date of Patent: Sep. 25, 2007

(54) PROCESS FOR THE PRODUCTION OF GASOLINE STOCKS

(75) Inventors: Amarjit S. Bakshi, Houston, TX (US); Mitchell E. Loescher, Houston, TX (US); Nishit Sahay, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 242 days.

(21) Appl. No.: 10/978,111

(22) Filed: Oct. 29, 2004

(65) Prior Publication Data

US 2005/0113612 A1 May 26, 2005

Related U.S. Application Data

(63) Continuation of application No. 09/557,523, filed on Apr. 24, 2000, now abandoned.

(60) Provisional application No. 60/132,363, filed on May 4, 1999.

(51) Int. Cl.
*C07C 2/74* (2006.01)

(52) U.S. Cl. ..... 585/255; 585/310; 585/414; 203/29

(58) Field of Classification Search ..... 203/29; 585/255, 310, 414
See application file for complete search history.

(56) References Cited

U.S. PATENT DOCUMENTS 3,960,978 A 6/1976 Givens et al. ..... 260/683.15 R
4,150,062 A 4/1979 Garwood et al. ..... 260/673
4,211,640 A 7/1980 Garwood et al. ..... 208/255
4,227,992 A 10/1980 Garwood et al. ..... 208/46
4,334,113 A 6/1982 Pellegrini, Jr. et al. ..... 585/18
4,375,576 A 3/1983 Smith, Jr. ..... 585/510
4,377,393 A 3/1983 Schleppinghoff ..... 44/53
4,463,211 A 7/1984 Manning ..... 585/510
4,720,600 A 1/1988 Beech, Jr. et al. ..... 585/330
5,003,124 A 3/1991 Smith, Jr. et al. ..... 585/526
5,113,034 A 5/1992 Soled et al. ..... 585/510
5,324,878 A 6/1994 Brunelli et al. ..... 585/508
5,510,555 A 4/1996 Brunelli et al. ..... 585/508
5,571,445 A 11/1996 Srinivasan et al. ..... 508/189
5,608,133 A 3/1997 Chang et al. ..... 585/524
5,610,112 A 3/1997 Lago et al. ..... 502/63
5,612,270 A 3/1997 Beck et al. ..... 502/64
5,639,931 A 6/1997 Hellring et al. ..... 585/722
5,670,681 A 9/1997 Kuber et al. ..... 556/53
5,776,320 A * 7/1998 Marion et al. ..... 203/29
5,877,372 A 3/1999 Evans et al. ..... 585/510
5,888,355 A 3/1999 Mikitenko et al. ..... 203/DIG. 6
6,080,903 A * 6/2000 Stine et al. ..... 585/514

* cited by examiner

*Primary Examiner*—Glenn Caldarola
*Assistant Examiner*—Prem C Singh
(74) *Attorney, Agent, or Firm*—Osha Liang LLP

(57) ABSTRACT

A process for the production of gasoline stocks wherein lower molecular weight olefins are first oligomerized and the oligomers then hydrogenated. In the first instance the oligomerization is carried out in a single pass fixed bed boiling point reactor. The oligomers are then hydrogenated in a distillation column reactor.

2 Claims, 1 Drawing Sheet

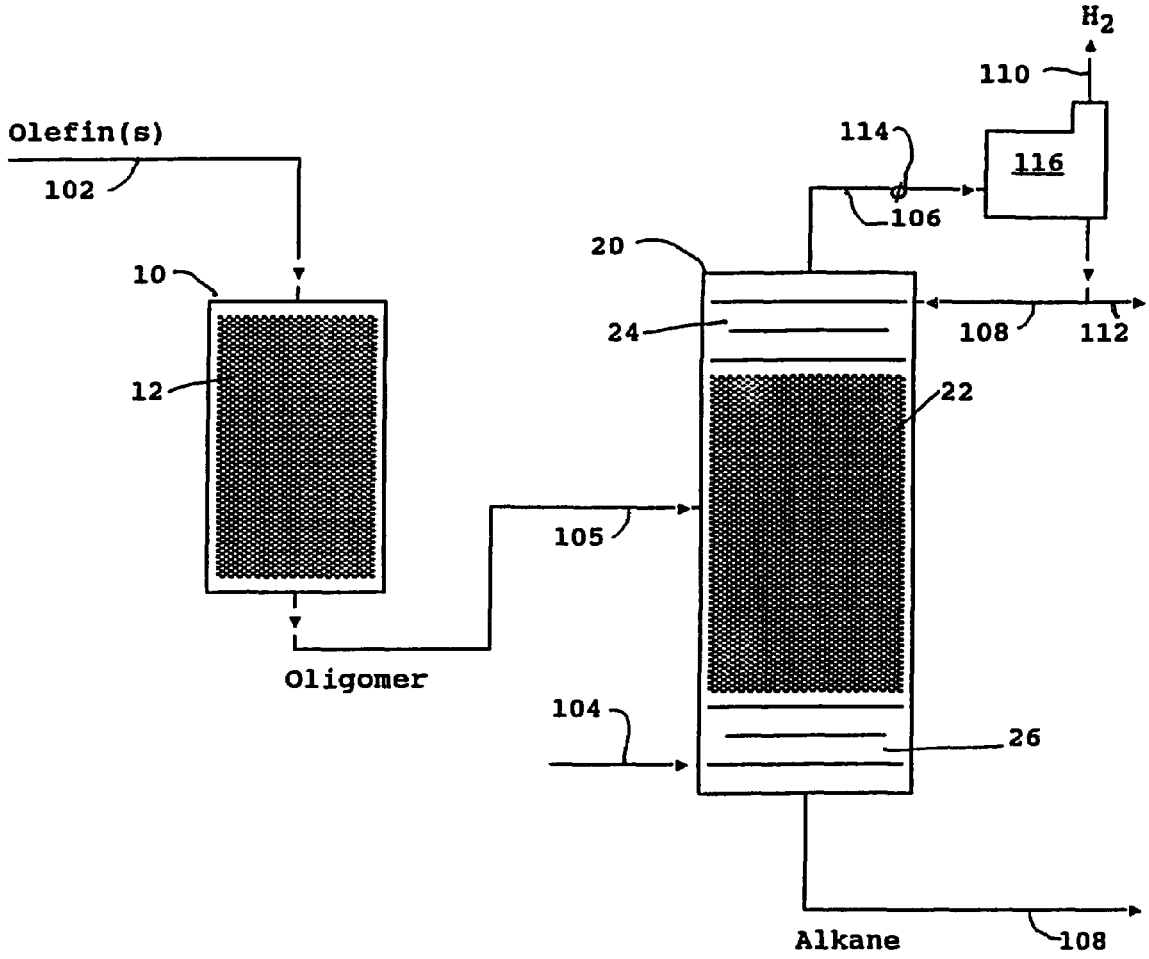
$H_2$
110
114
116
106
Olefin(s)
102
20
10
24
108
112
12
22
105
Oligomer
104
26
Alkane
108

PROCESS FOR THE PRODUCTION OF GASOLINE STOCKS

This is a continuation of Ser. No. 09/557,523 filed on Apr. 24, 2000 now abandoned which claims the benefit of U.S. Provisional Application 60/132,363 filed May 04, 1999.

BACKGROUND OF THE INVENTION

1. Field of the Invention

The present invention relates generally to a process for the production of gasoline boiling range stocks from lower boiling olefins. More particularly the invention relates to a process wherein $C_3$ to $C_5$ olefins are oligomerized to produce $C_8$ to $C_9$ olefins which are then hydrogenated to produce desirable gasoline blending stocks.

2. Related Art

Conversion of olefins to gasoline and/or distillate products is disclosed in U.S. Pat. Nos. 3,960,978 and 4,021,502 wherein gaseous olefins in the range of ethylene to pentene either alone or in admixture with paraffins are converted into an olefinic gasoline blending stock by contacting the olefins with a catalyst bed made up of a ZSM-5 type zeolite. In U. S. Pat. No. 4,227,992, Garwood and Lee disclose operating conditions for the selective conversion of $C_3$+olefins mainly to aliphatic hydrocarbons. Also U. S. Pat. Nos. 4,150,062 and 4,211,640 disclose a process for converting olefins to gasoline components. Chang, et al, in U.S. Pat. No. 5,608,133 disclose production of synthetic lubricants by oligomerization of $C_2$-$C_5$ olefins and subsequent hydrogenation of the higher boiling olefins. A liquid phase process for the oligomerization of $C_4$ and $C_5$ isoolefins is disclosed in U.S. Pat. No. 5,003,124 wherein the reaction mixture is allowed to boil to remove the heat of reaction and in one embodiment a further dimerization is obtained in a reactive distillation column.

Brunelli, et al, in U.S. Pat. No. 5,510,555 disclose that the two isomers of di-isobutylene, 2,4,4-tri-methyl pentene and 2,4,4-tri-methyl-2-pentene when hydrogenated both yield 2,2,4 tri-methyl pentane which is the standard for octane measurement, i.e., RON=100 and MON=100.

SUMMARY OF THE INVENTION

Briefly the present invention comprises the oligomerization of lower olefins and then the hydrogenation of the oligomers. The oligomerization is preferably carried out in a boiling point reactor under conditions which favor dimerization as opposed to longer chain oligomers wherein the temperature is controlled by allowing the reaction mixture to boil absorbing the latent heat of vaporization. If desired the effluent from the boiling point reactor may be fed to a distillation column reactor to insure complete reaction of the olefins. Catalysts useful for the oligomerization reaction include acidic cation exchange resins or zeolites.

The dimers produced in the oligomerization reaction are then hydrogenated preferably in a reactive distillation. The dimers may be fed along with a hydrogen stream to a reaction distillation column at an effectuating hydrogen partial pressure of at least about 0.1 psia to less than 70 psia, such as less than 50 psia. The reaction distillation column reactor contains a hydrogenation catalyst which is a component of a distillation structure and selectively hydrogenating a portion of the dimers. Within the hydrogen partial pressures as defined no more hydrogen than necessary to maintain the catalyst and hydrogenate the olefinic compounds is employed, since the excess hydrogen is usually vented. Typical hydrogenation catalysts are Group VIII metals supported on an alumina base and include, among others, platinum, nickel, and cobalt.

The term "reactive distillation" is used to describe the concurrent reaction and fractionation in a column. For the purposes of the present invention, the term "catalytic distillation" includes reactive distillation and any other process of concurrent reaction and fractional distillation in a column regardless of the designation applied thereto.

The catalyst beds as used in the present invention may be described as fixed, meaning positioned in a fixed area of the column and include expanded beds and ebulating beds of catalysts. The catalysts in the beds may all be the same or different so long as they carry out the function of hydrogenation as described. Catalysts prepared as distillation structures are particularly useful in the present invention.

BRIEF DESCRIPTION OF THE DRAWING

The FIGURE is a flow diagram in schematic form of a one embodiment of the invention.

DETAILED DESCRIPTION OF THE INVENTION

The olefins which may be oligomerized in the present invention include propylene, butenes and pentenes. Particularly the isobutenes and isopentenes (isoamylenes) and the linear α olefins are useful. Typically the internal linear $C_4$ and $C_5$ olefins are less reactive than the α- or iso-olefins of the same carbon number.

The oligomerization reactions of interest include:

(1) Propylene+Isobutylene ⟹ Heptenes (2) Isobutylene+Isobutylene ⟹ Di-isobutylenes (3) n-butenes+Isobutylene ⟹ octenes (4) Isoamylene+Propylene ⟹ Octenes (5) Isoamylene+butylene ⟹ nonenes The higher olefins are then hydrogenated to produce alkanes which are useful as gasoline blending stock. The dimerization of isobutylene with itself is of particular interest because either of the isomers of di-isobutylene produce 2,2,4-trimethyl pentane (isooctane) when hydrogenated. The tertiary olefins are more reactive and tend to form dimers, some codimers and higher oligomers The oligomerization reaction is preferably carried out in a boiling point reactor in the presence of an acidic particulate catalyst such as an acidic cation exchange resin or zeolite at a pressure sufficient to maintain the reaction mixture at its boiling point within the range of 120° F. to 300° F. whereby at least a portion but less than all of the reaction mixture is in the vapor phase. Such a reactor and process is described in U.S. Pat. No. 5,003,124 which is incorporated herein.

A given composition, the reaction mixture, will have a different boiling point at different pressures, hence the temperature in the reactor is controlled by adjusting the pressure to the desired temperature within the recited range. The boiling point of the reaction mixture is thus the temperature of the reaction, and the exothermic heat of reaction is dissipated by vaporization of the reaction mixture. The maximum temperature of any heated liquid composition will be the boiling point of the composition at a given pressure, with additional heat merely causing more boil up. The same principal operates in the present invention to control the temperature. There must be liquid present, however, to provide the boil up, otherwise the temperature in the reactor will continue to rise until the catalyst is damaged. In order to avoid exotherms which will vaporize all of the reaction mixture it is necessary to limit the amount of olefin in the feed to the reactor to about 60% of the total feed. The present invention can be used on streams containing any of the various olefins or mixtures thereof The temperature must be carefully controlled to prevent formation of trimers and heavier products. The boiling point reactor lends itself very well to such control.

The catalyst bed in the boiling point reactor may be described as a fixed continuous bed, that is, the catalyst is loaded into the reactor in its particulate form to fill the reactor or reaction zone, although there may be one or more of such continuous beds in a reactor, separated by spaces devoid of catalyst.

The resin or zeolite catalyst is loaded into a partial liquid phase boiling point reactor as a fixed bed of the granules. The feed to the reaction is fed to the bed in liquid phase. The bed may be horizontal, vertical or angled. Preferably the bed is vertical with the feed passing downward through the bed and exiting, after reaction, through the lower end of the reactor. The reactor is operated at a high liquid hourly space velocity (5-20 LHSV, preferably 10-20) to avoid the reverse reaction and polymerization of the olefins. These conditions result in about 80-90% conversion of the olefins and it may be desirable to have two and possibly more of the reactors in series to obtain the desired overall conversion of the olefin.

The oligomers may be separated from the reactants by conventional distillation with the oligomer products being removed as bottoms and unreacted feed recovered as overheads. Alternatively the effluent from the boiling point reactor may be fed to a distillation column reactor containing the same or similar catalyst to obtain the desired conversion and concurrently separate the products from the unreacted feed.

The oligomers are then fed to a hydrogenation zone, preferably a distillation column reactor containing a hydrogenation catalyst. The catalytic material employed in the hydrogenation process is preferably in a form to serve as distillation packing. Broadly stated, the catalytic material is a component of a distillation system functioning as both a catalyst and distillation packing, i.e., a packing for a distillation column having both a distillation function and a catalytic function. The catalyst is prepared in the form of a catalytic distillation structure. More particularly the hydrogenation catalyst generally comprises a Group VIII metal supported on an alumina carrier in the form of extrudates or spheres. The extrudates or spheres are placed in porous containers and suitably supported in the distillation column reactor to allow vapor flow through the bed while providing a sufficient surface area for catalytic contact.

Among the metals known to catalyze the hydrogenation reaction are platinum, rhenium, cobalt, molybdenum, nickel, tungsten and palladium. Generally, commercial forms of catalyst use supported oxides of these metals. The oxide is reduced to the active form either prior to use with a reducing agent or during use by the hydrogen in the feed. These metals also catalyze other reactions, most notably dehydrogenation at elevated temperatures.

The reaction system can be described as heterogeneous since the catalyst remains a distinct entity. Any suitable hydrogenation catalyst may be used, for example Group VIII metals of the Periodic Table of Elements as the principal catalytic component, alone or with promoters and modifiers such as palladium/gold, palladium/silver, cobalt/zirconium, nickel preferably deposited on a support such as alumina, fire brick, pumice, carbon, silica, resin or the like.

To provide the desired degree of temperature and residence time control, a process and apparatus are provided wherein the reaction liquid is boiling within a distillation column reactor. Overheads are withdrawn and condensed with some of the condensate being returned to the distillation column reactor as reflux. The advantage of the present process is that due to the continual reflux a portion of the selected oligomer is always condensing on the catalyst structure.

In the distillation column reactor it is believed that the effectiveness of the hydrogenation process may be the result of the condensation of a portion of the vapors in the reaction system which occludes sufficient hydrogen in the condensed liquid to obtain the requisite intimate contact between the hydrogen and the selected oligomers in the presence of the catalyst to result in their hydrogenation. The vaporization of the liquid feed removes a substantial amount of the exothermic heat of reaction. Since the liquid is at the boiling point in the reactor, the temperature may be controlled by the pressure. An increase in pressure increases the temperature and a decrease in pressure decreases the temperature.

Several different arrangements have been disclosed to achieve the desired result. For example, British Patents 2,096,603 and 2,096,604 disclose placing the catalyst on conventional trays within a distillation column. A series of U.S. patents, including those listed above and more, particularly U.S. Pat. Nos. 4,443,559 and 4,215,011 disclose using the catalyst as part of the packing in a packed distillation column. The use of multiple beds in a reaction distillation tower is also known and illustrated, for example, in U.S. Pat. Nos. 4,950,834; 5,321,163; and 5,595,634.

One suitable catalyst structure for the hydrogenation of the oligomers comprises at least one plurality of flexible, semi-rigid open mesh tubular elements filed with a particulate catalytic material (catalyst component) and sealed at both ends, intimately associated with and supported by a wire mesh screen coiled into a spiral having a longitudinal axis, said tubular element being arrayed at an angle to the longitudinal axis thereby forming a bale and is described in detail in U.S. Pat. No. 5,431,890 incorporated herein in which a flexible, semi-rigid open mesh tubular element filled with a particulate catalytic material preferably has a fastener every 1-20 inches along the length of the tube to form a multiple link shaped catalytic distillation structure. The links formed by the fasteners may be evenly or irregularly spaced. Bale shaped catalytic distillation structures are formed by placing at least one tubular element on top of the wire mesh screen such as demister wire, in a diagonal array such that when the wire mesh screen is rolled up the rolled structure provides a new and improved catalytic distillation structure.

Further embodiments include multiple stack arrangements of alternating wire screen mesh and tubular elements that are rolled into a new bale shaped catalytic distillation structure. The tubular elements on alternating layers are preferably arrayed on the wire mesh screen in opposite directions such that their paths cross. Each tubular element will define a spiral within the bale.

The catalyst component may take several forms. In the case of particulate catalytic material, generally from 60 mm to about 1 mm down through powders, is enclosed in a porous container such as screen wire or polymeric mesh. The material used to make the container must be inert to the reactants and conditions in the reaction system. The screen wire may be aluminum, steel, stainless steel, and the like. The polymer mesh may be nylon, teflon, or the like. The mesh or threads per inch of the material used to make the container is such that the catalyst is retained therein and will not pass through the openings in the material. Although the catalyst particles of about 0.15 mm size or powders may be used and particles up to about ¼ inch diameter may be employed in the containers.

The reaction conditions in the distillation column reactor must be sufficient to hydrogenate the olefin to the alkane. The conditions of pressure and temperature to hydrogenate only the dienes, e.g., 150° F. to a maximum temperature of 170-200° F. at 10 to 75 psig. To hydrogenate the mono olefins more severe conditions are required 200-350° F., at 30 to 150 psig.

Referring now to the FIGURE a simplified flow diagram of one embodiment of the invention is shown. The feed containing the olefin or olefins to be oligomerized are fed via flow line 102 to boiling point reactor 10 containing a bed of catalyst 12, either an acidic ion exchange resin or a zeolite. In the boiling point reactor the olefins react with themselves or one another to produce a longer chain oligomer (principally dimer) which is removed from the reactor via flow line 105 to distillation column reactor 20.

Distillation column reactor 20 contains a bed 22 of hydrogenation catalyst suitable to act as a distillation structure. The oligomers, e.g. dimers, or at least a part, are hydrogenated to the corresponding alkane, which having a higher boiling point is removed as bottoms via flow line 108. By maintaining the pressure conditions to hold the dimer within the catalyst zone 22, the dimers can be completely hydrogenated. Unreacted olefin monomers, alkanes in the feed and hydrogen are removed as overheads via flow line 106. The overheads are condensed in condenser 114 and collected in separator 116. Hydrogen is removed via line 110 and may be recycled to flow line 104. A portion of the condensed hydrocarbons are returned as reflux via line 108 and a portion removed via line 112 which may be recycled to line 102. A rectification section 24 containing standard distillation structure such as trays or packing is provided above the catalyst bed 22. Likewise a stripping section 26 is provided below the catalyst bed 22.

Other embodiments not shown but which are considered to be encompassed by the invention include multiple boiling point reactors to achieve the desired olefin conversion or a distillation column reactor following the boiling point reactor.

EXAMPLE

A $C_4$ feed containing 14.2 wt. % isobutene, 72.7 wt. % other $C_4$'s with the balance principally $C_3$'s and $C_5$'s is passed downflow through a fixed bed of Amberlyst 15 beads bed at LHSV of 10 at 90° F. to produce a conversion of isobutene of over 85%.

The total effluent from the reaction is fed at the top of a catalyst zone located in a one inch diameter column which is loaded with 10 feet of 0.5 wt % Pd on ⅛" $Al_2O_3$ (alumina) extrudates, hydrogenation catalyst, (Calsicat E144SDU) prepared as distillation structure. A stripping section of 2 feet containing Pall rings is below the catalyst bed. The total pressure is 75 psig at 175° F. at LHSV 10. The heavier oligomer drops into the catalyst zone where it contacts hydrogen fed below the catalyst zone at a hydrogen partial pressure of 10 psig converting substantially all of the oligomer (principally dimer) to alkane which is recovered as bottoms. Overheads are the $C_3$'s and $C_4$'s and $C_5$'s and unreacted hydrogen.

The invention claimed is:

1. A process for the production of gasoline components comprising the steps of:

(a) feeding a hydrocarbon stream containing $C_3$-$C_5$ olefins to a single pass downflow fixed bed reactor containing a cationic acidic resin catalyst under oligomerization conditions within the range of 120° F. to 300° F. wherein the temperature in said reactor maintains a boiling mixture in said reactor thereby reacting at least a portion of said $C_3$-$C_5$ olefins with each other or themselves to form oligomers;

(b) feeding the effluent from said single pass downflow fixed bed reactor and hydrogen to a distillation column reactor containing hydrogenation catalyst consisting essentially of Pd on an alumina support in a distillation reaction zone;

(c) concurrently in said distillation reaction zone under conditions of concurrent hydrogenation and distillation:

(i) contacting said oligomers with said hydrogen in the presence of said hydrogenation catalyst at a temperature of 150° F.-350° F., at 10 to 150 psig to hydrogenate a portion of said oligomers to the corresponding alkanes; and (ii) separating the corresponding alkanes from other hydrocarbons and hydrogen by fractional distillation;

(d) removing said corresponding alkanes from said distillation column reactor at a point below said distillation zone;

(e) removing said other hydrocarbons and hydrogen from said distillation column as overheads;

(f) cooling said overheads to separate said other hydrocarbons from said hydrogen; and (g) recycling a portion of said other hydrocarbons to said distillation column reactor as reflux.

2. The process according to claim 1 wherein said hydrogen is recovered from overheads and recycled to said distillation column reactor.

* * * * *